US008628072B2

(12) United States Patent
Swanson

(10) Patent No.: US 8,628,072 B2
(45) Date of Patent: Jan. 14, 2014

(54) UNIVERSAL CLAMPING BLOCK

(76) Inventor: David Swanson, Tustin, CA (US)

( * ) Notice: Subject to any disclaimer, the term of this patent is extended or adjusted under 35 U.S.C. 154(b) by 204 days.

(21) Appl. No.: 13/093,711

(22) Filed: Apr. 25, 2011

(65) Prior Publication Data

US 2012/0267839 A1 Oct. 25, 2012

(51) Int. Cl.
*B25B 5/16* (2006.01)

(52) U.S. Cl.
USPC ..... 269/280; 269/264; 269/259; 269/278

(58) Field of Classification Search
USPC ..... 269/163, 246, 258, 259, 264–268, 271, 269/277–280, 283, 41, 6
See application file for complete search history.

(56) References Cited

U.S. PATENT DOCUMENTS 149,425 A * 4/1874 Banks et al. ..... 269/109
205,239 A * 6/1878 Brower ..... 269/258
214,403 A * 4/1879 Lane ..... 269/220
357,524 A * 2/1887 Denney ..... 269/219
663,343 A * 12/1900 Harris ..... 269/219
842,555 A * 1/1907 Johnson ..... 269/161
891,121 A * 6/1908 Wichers ..... 269/108
1,015,171 A * 1/1912 Goble ..... 269/153
1,583,964 A * 5/1926 Driggers ..... 269/315
1,643,838 A * 9/1927 Corbin ..... 269/131
4,247,090 A * 1/1981 Hahn et al. ..... 269/41
4,510,977 A * 4/1985 Crowley ..... 140/123
6,000,686 A * 12/1999 Yates ..... 269/6
6,860,475 B2 * 3/2005 Wong ..... 269/41
7,254,895 B1 * 8/2007 O'Donnell ..... 33/293
2008/0315480 A1 * 12/2008 Iacobelli et al. ..... 269/277
2009/0224453 A1 * 9/2009 Duss et al. ..... 269/134
2010/0040432 A1 * 2/2010 Totsu ..... 411/426

* cited by examiner

*Primary Examiner* — Lee D Wilson
*Assistant Examiner* — Tyrone V Hall, Jr.
(74) *Attorney, Agent, or Firm* — Donn K. Harms

(57) ABSTRACT

An interface component is provided for use in combination with a clamp or compressive tool imparting a compressive force against respective planar contact surfaces of two components being joined at a miter joint. The interface features an elongated member having a projection projecting away from a top surface in a substantially circular path. The curved surface provides a means to redirect the compressive force communicated against said curved surface to the miter joint at a substantially normal angle.

19 Claims, 4 Drawing Sheets

UNIVERSAL CLAMPING BLOCK

BACKGROUND OF THE INVENTION

1. Field of the Invention

The present invention relates to miter clamps and more particularly to a clamping block used with conventional clamping tools to assist in clamping miters and various angles in wood.

2. Prior Art

In construction of wooden frames such as picture frames, door frames, and the like, joining angled corners, know as miter joints, are engaged together often by adhesives, screws, or nails. Due to the limited ability of a single laborer, miter joints must to be held in place by clamps, or similar apparatus to support the joint prior to glueing or nailing. Prior art clamps have shown many attempts to accomplish this.

U.S. Pat. No. 1,222,204 to Hanson teaches a clamping device used especially for the gluing of mitered corners of a frame. The clamp is adjustable along all edges of a typical frame construction and allows for adaptability for many types of miter joints. However, the device is overly complex in design and as such could be easily prone to user error. Furthermore, the Hanson device involves many components that if misplaced, as can happen in a workshop, render the device inoperable.

U.S. Pat. No. 4,162,785 to Johnson teaches a miter clamp employing an adjustable screw member for applying contact force on two mitered surfaces. In use however, means for engaging the device to the mitered elements involves inserting pins into the surface of the mitered elements leaving visible holes when removed. Since it is often desired to maintain aesthetic appeal on visible surfaces especially on the construction of a picture frame or the like, the device and method of this patent are undesirable. Many other prior art clamps especially those employing small clamping pads such as U.S. Pat. No. 2,941,557 to Baprawski are known to cause visible damage and are undesirable.

The above devices, as well as many other prior art miter clamps and similar clamping devices fall short in the areas mentioned. Additionally, some are not only costly due to complexity and other issues, they are also bulky, and occupy an inordinate amount of space in the already cluttered construction or workshop environment. Introduction of new and complex equipment that, although build upon technological progress and innovation, can cause unneeded frustration to the common laborer. As a consequence, simplicity along with innovation can provide much more progress in technological advancement.

As such, there is a continuing and unmet need for a clamp, clamping device, or clamping aid, that is easy to manufacture, cost effective, and easy to use. Such a device should be easily adaptable to the installed base of equipment already employed on the construction site or in workshops to insure easy and widespread employment in combination with exiting tools and methods. Such a device should be simple to use and in construction, to even further reduce costs, as well as reduce user-frustration due to the often excessive complexity of newly introduced devices.

SUMMARY OF THE INVENTION

The device herein disclosed and described provides a solution for the above noted shortcomings in prior art through the provision of a miter joint clamping tool that is used in combination with existing conventional temporary fixation devices such as C-clamps, F-clamps, bar clamps, clam clamps or the like. The device is a substantial improvement when employed in woodworking to assist in clamping miter joints and various angles often seen in wooden frame structures and wood formed components and furniture.

The device is employed as an interface to provide a much easier and more secure footing for a wide variety of compression components while alleviating the need for a plurality of other conventional parts. Concurrently the device provides a means to prevent compression and abrasion damage which is often caused by the small clamping pads and other components employed upon conventional clamps mentioned previously.

Since the device can be employed with clamping and compression imparting components, which are conventionally employed and already familiar to most construction laborers, the disclosed device offers a simpler solution to the complex apparatus of the same scope, while concurrently providing increased utility. This increased utility is provided by the device as it can be employed as a footing upon an infinite number of angles which might accompany the formation of a miter joint, including 90 degree butt joints. This ability to provide a secure interface between the wood being joined and a wide variety of different compression imparting components, which may be engaged at virtually any angle, eliminates the need for the vast array of specialty tools available in the wood working tool industry.

In a particularly preferred mode, the device of the present invention is formed of a machined or extruded material such as aluminum. The device features an elongated body having a first surface which is substantially planar and having a thickness which is appreciably less than its width. At one distal end along the length of the device there is positioned a circular projection configured for engagement with compression imparting components. In a particularly preferred mode the projection has an exterior surface which follows a circular loop which terminates back on itself after completing a 360-degree path. This projection provides a means to engage with and interface between an existing clamping device and the underlying wood, to provide an especially secure elongated mount which maintains contact pressure upon the wood or other material being engaged at a miter joint.

At the intersection of the interior portion of the projection and first planar surface, the curved exterior of the projection continues to form a slight notch portion at the intersection of the exterior surface of the projection and the planar surface. This notch is so positioned so that a user can hang the projection or loop part of device, upon a side edge of a piece of wood, in the clamping block mode, without the curve of the projection interfering with the contact between the device and the wood edge, or causing it to slip off. The notched area also allows a clamping means, to attach to the side of the projection without slipping off, which is especially preferred should the clamp have soft pads on the gripping opposing surfaces of the clamp. Still further, the inward curve of the exterior surface of the projection, toward the distal end of the planar surface, and then back again, provides the additional strength afforded by an arch when being pressured by clamping means which would be lacking were the exterior surface of the projection to intersect the planar surface at a perpendicular angle. Further, the formed recess or notch in place of a straight right angle intersection of the surfaces, also reduces the metal content of the device slightly which lessens the production cost. As such, the curved notched or recessed area, at the intersection of the curved exterior surface of the projection, and the planar surface of the device, is most preferred.

Optionally, the device may also have indicia positioned upon its non-engaging surface in the form of measurement or ruler markings along the length of the body. Such provides a means to visually aid in determining lengths from edges, corners, or the like as needed.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the concept upon which this disclosure is based may readily be utilized as a basis for designing of other structures, methods and systems for carrying out the several purposes of the present disclosed device for employment as an interface device in miter clamping. It is important, therefore, that the claims be regarded as including such equivalent construction and methodology insofar as they do not depart from the spirit and scope of the present invention.

It is an object of the invention to provide a device to be employed in combination with conventional clamping means provide an interface and engagement at virtually any angle.

It is a further object of this invention to provide a mounting interface between a clamping component and material being joined in a joint, to reduce damage to the structural elements forming the resulting miter joint while also providing secure contact pressure.

It is another object of the invention to provide a device that is easily manufactured and easily used and therefor widely employable.

It is a further object of the invention to provide a device that is easily employed on any angle of a miter joint.

Another object of the invention is the provision of scaled markings along its length to aid in distance determination as needed.

These together with other objects and advantages of the disclosed device configured to interface between clamping components and materials forming a mitered joint, which will become subsequently apparent to those skilled in the art, reside in the details of the construction and method herein as more fully hereinafter described and claimed, reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
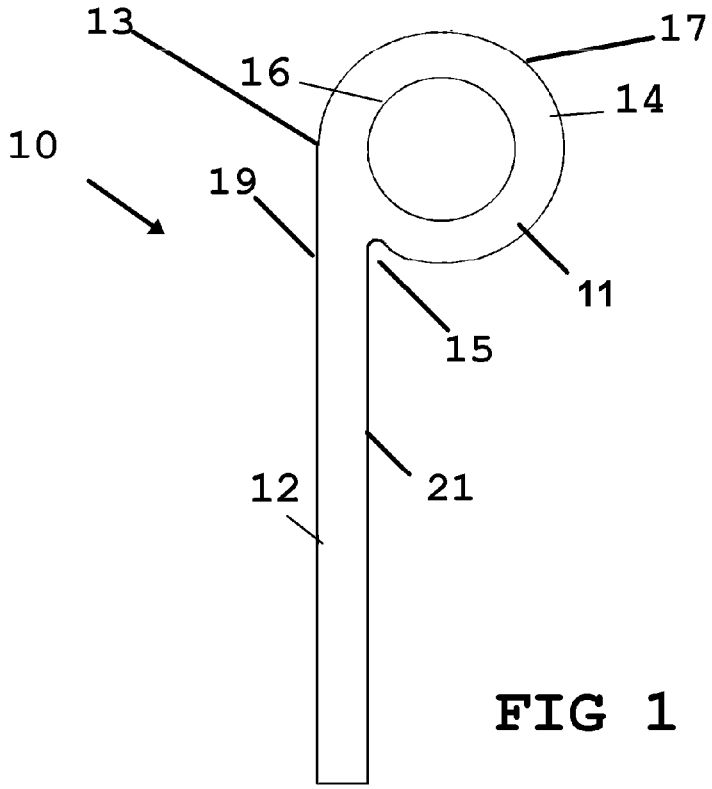
FIG. 1 shows a side profile view of the device.

Now referring to drawings in FIGS. 1-6, wherein similar components are identified by like reference numerals, there is seen in FIG. 1 a side profile view of the device 10 in a preferred mode. As depicted, the device 10 consists of an elongated member 12 forming a body portion, having a substantially planar bottom or first planar surface 19 and parallel and substantially planar top or second planar surface 21. One or a plurality of projections 11 extend from the second planar surface 21 as shown in the drawing FIGS. 1,2, and 6.

The device 10 may be formed of hard plastic or ceramic materials, or most preferably of metal, by machining or molding or in an extrusion. A currently preferred mode of the device 10 is formed of an extruded material such as aluminum, hard plastic, or the like, which is then cut to size and its surfaces planed if necessary.

Figure 2:
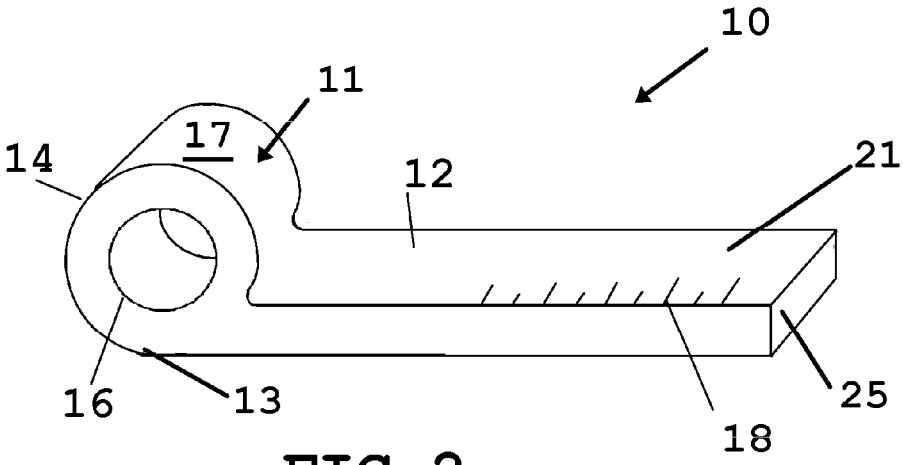
FIG. 2 is an isometric view of the device.

In the particularly preferred mode of the device 10 of FIGS. 1 and 2, in a unitary structure, a generally circular shaped projection 11 extends in a circular path from a first end 13, opposite the second end 25. The projection 11 continues in a circular path defined by a circular or curved surface 17 to an intersection point with the top or second planar surface 21. The curved surface 17 defines a curved engagement area for clamps and compressive tools, to allow them to engage at any clamping point or position around the curved surface 17. An aperture 16 formed within the curved surface 17, renders the projection 11 to appear as a circular loop element 14 in the depicted mode of the projection 11.

As shown, the curved surface 17 provided by the projection 11 appears as a continuation of the first or lower planar surface 19 of elongated member 12 in a curving from the first end 13, and it then communicates in a generally circular curve, to an intersection point with the second planar surface 21 of the elongated member 12 defining a body of the device 10. A notch 15 is formed at the communication point of the curved surface 17 with the upper or second planar surface 21 of the elongated member 12. The notch 15 as can be seen in FIG. 1 and in duplicate in FIG. 6, is formed by a U-shaped continuation of the curved surface 17 to a meeting with the second planar surface 21, and is positioned such that the curved surface 17 does not intersect with the second planar surface 21 in a perpendicular fashion.

This curved surface 17, which provides a means for angular or tangential engagement with contacting engagement sections of clamping components employed in combination herewith, extends to form a substantially circular curve which if completed around the projection 11 would yield a curved surface in a 360-degree fashion.

While this circular curved surface 17 is most preferred due to its exceptional means to engage clamping components and communicate force therefrom to the elongated member 12, it must be noted however that the first end 13 as in FIG. 1, may incorporate a protruding element having a different curve or shape other then substantially circular as depicted, and it would still provide a substantial improvement in the transference of clamping components force to materials being mitered. Consequently other circular or curved shapes of the projection 11 defined by its exterior curved surface 17 as would occur to those skilled in the art are still considered to be within the scope of the invention. This is because the curved surface 17 provides a means to engage the pressure-exerting surfaces of clamping components at multiple angles and to redirect and communicate the force to the first surface 19 of the elongated member 12 to thereby communicate an even and superior compressive force on the material such as wood, contacting the first surface 19 and additionally thereby provide a means to prevent dents and abrasions thereto concurrently through this even planar communication of force from angled clamping or compressive means.

Figure 6:
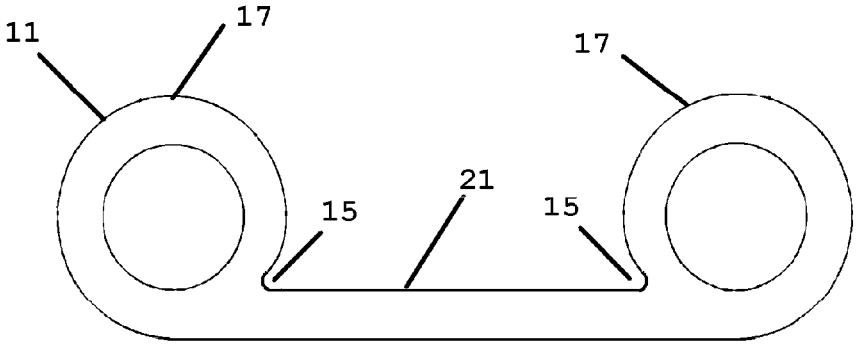
FIG. 6 shows a mode of the device having two projections with curved surface exteriors located at opposite ends of the planar member.

Also depicted in the particularly preferred modes of the device 10 in FIGS. 1 and 6, are the circular aperture 16 that communicates through projection 11 traverse to the axis of the body of the device 10 to form the circular loop element 14. As can be seen, the curved surface 17 substantially parallels the circular aperture 16 between its intersection with the first surface 19, and the second planar surface 21 of the elongated member 12. The formed aperture 16 reduces the amount of material needed to manufacture the device 10 saving the cost thereof, and provides a passage through the device 10 for engagement to a support for storing it, and should the device be engaged with its side contacting the wood, wherein one side of a clamp can engage the wood material through the passage provided by the aperture 16 if desired.

FIG. 2 shows an isometric view of the device 10. Optional indicia such as ruler markings 18 can be etched, drawn, or engraved onto the second surface of the elongated member 12 of the device 10. It is often required during any construction process to determine a specific length or distance for instance from an edge or a pair of butted surfaces. Incorporation of such markings 18 to the device 10 provide a convenient means to visually ascertain a distance and negate the need for a ruler or tape which would be inaccurate if placed over the device 10, or when a ruler or tape measure which would also lack accuracy should it have to traverse over the device.

Figure 3:
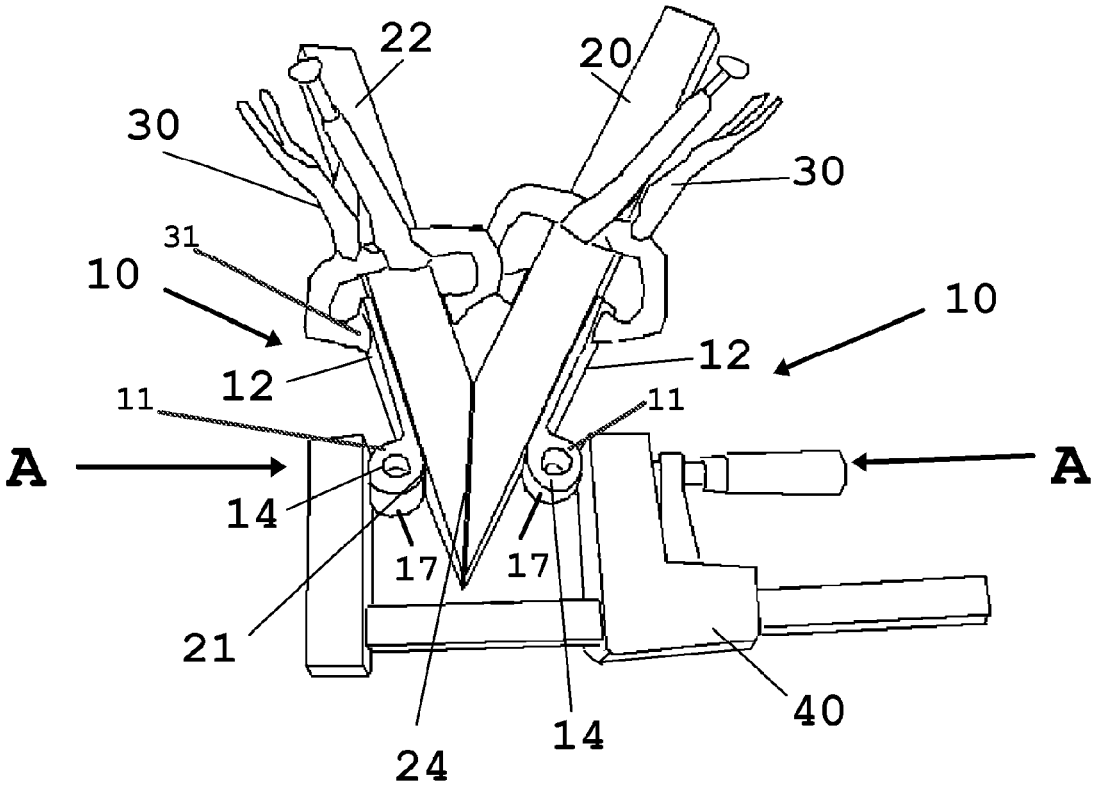
FIG. 3 shows the device in operative engagement as an interface with conventional clamping tools in one possible as-used mode.
Figure 4:
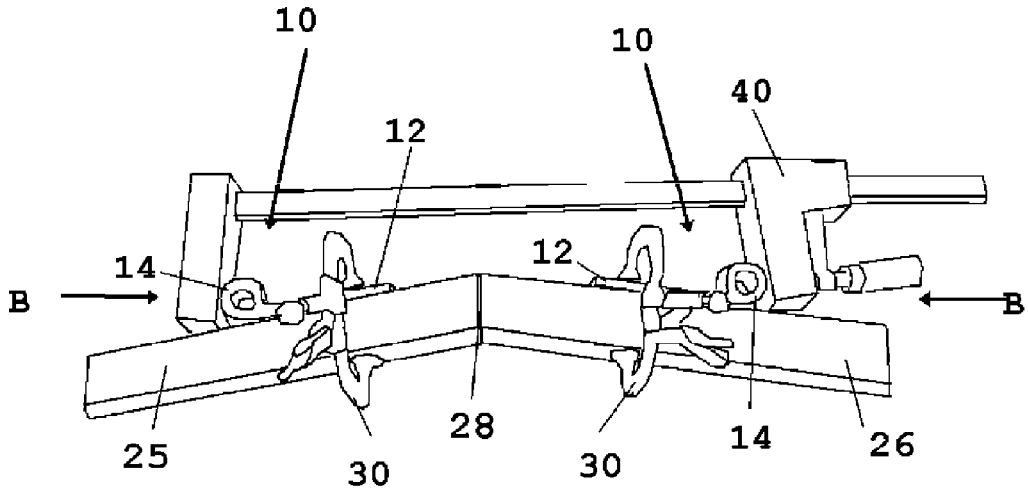
FIG. 4 shows the device in an operative engagement with conventional clamping tools in yet another typical as-used mode.

In the as-used mode such as in FIGS. 3-4, one or a plurality of the disclosed devices 10 are operatively engaged as an interface with and/or between conventional compressive clamping tools such as locking C-clamps 30 and bar clamps 40 engaged on the curved surfaces 17. As noted this means for tangential engagement allows a directing of the clamping force to the miter joint 24, in a manner with the surfaces of the bar clamps 40 being parallel to the miter joint 24 as depicted in FIG. 3. The angular contacting surface of the curved surface 17 allows for this enhanced angling of compressive forces in line with the joint 24 and protects the soft wood surfaces from over-compression as would usually occur just using the clamps 40 and C-clamps 30. As shown a first joining member 20 and a second joining member 22 are engaged at a miter joint 24 where commonly an adhesive (not shown) is applied for maintaining a permanent engagement once pressure is removed.

The device 10 is engaged with its first surface 19 in contact with the material forming the members being joined at the miter joint, at or near the miter joint 24. In this as-used position in combination with compression exerting components engaged thereto, the elongated member 12 extends toward the distal ends of the joining members 20,22 and is held in place by conventional locking C-clamps 30 as shown. So engaged, the device 10 communicates the force from the clamps 30, as well as that of the bar clamp 40, in opposing directions substantially normal to the joint 24. As shown, the small foot 31 of the clamps 30 would normally be prone to dent or damage wood or a soft surface. However, the device 10 provides a means to absorb and redirect the force of the clamps 30 in a much wider contact of the first surface 19 and achieves a better grip and a more even force transfer than the small footprint of such clamps 30.

The circular loop element 14 and curved surface 17 thereon is located at or near the midpoint of the contacting surfaces of the material, such as wood, forming this particular miter joint 24. As noted, employing the unique mounting positions afforded by the curved surface 17, in this manner the bar clamp 40 can exert a force along directions A from a contact line with the bar clamp 40 in a tangent to the curved surface 17. In this fashion, the device 10 communicates the force of the bar clamp 40 on the curved surface 17 and redirects it through the elongated member 12 over to the wide area of the first surfaces 19 of each respective elongated member 12, such that the contact force exerted to and at the miter joint 24, is substantially normal to both the surfaces adjacent to it. This allows the bar clamp 40 to apply an appreciable force to the device 10, from its clamping surfaces which themselves may be at disparate angles to each other, and have the device as an interface redirect and distribute the force in the most optimum direction against the material forming the joint 24.

Further, by providing a very large footprint for transference of such force, the device 10 in all preferred modes, provides a means to prevent compression and abrasion damage is provided and considerable force may be exerted in excess of what would normally be safe for such small-pad bar clamps 40, without damaging any surfaces of the joining members 20,22.

It must be noted that the scope of the invention as portrayed by the depiction in FIG. 3 can be similarly set forth by an almost infinite number of miter angles, types and sizes of joining members, as well as many other variable factors. By positioning the curved surface 17 to act to communicate with compressive components in a tangential communication and provide a means to redirect the force to the material being engaged in a miter, an infinite number of compressive imparting tools and clamps may be employed to achieve a clean and improved miter joint.

Due to the adaptive nature of the curved surface 17 of the device 10 to engage with any tool adapted to exert compression along a tangential line, it is then, of course, impossible to depict all such possibilities for the as-used mode of the disclosed device 10 in this application. Therefore the device 10 is operable with any tool or component which is configured to exert a compressive force between two opposing surfaces and redirect that force in a fashion that is normal to the planar surfaces intersecting at a mitered joint 24. Any such tool or component, which one skilled in the art might employ to exert a compressive force between two opposing surfaces of such a tool as would occur to those skilled in the art, is anticipated as employable in combination with the device 10 herein.

For the purpose of further demonstrating the scope and intention of the device 10, again without limiting the scope hereof, another depiction of a possible as-used mode of the device is shown in FIG. 4.

In FIG. 4, again, first 25 and second 26 joining members are engaged at inclining angles to an engagement at an angled miter joint 28 where adhesive (not shown) is conventionally applied for maintaining a permanent engagement once pressure is removed. The device 10 is employed as an interface and is engaged at or near the miter joint 28 and is temporarily engaged at a position on the elongated member 12 opposite the curved surface 17, by locking C-clamps 30 as shown. As those skilled in the art know, such c-clamps 30 have small opposing surface areas which exert the full compressive force of the c-clamp to the material therebetween and can damage soft surfaces like wood easily. The device 10 by providing an interface therebetween, distributes this force along a much larger area as a means to prevent compressive force damage.

The circular loop element 14 or similar extension above the member second planar surface 21 and having the curved surfaces 17 thereon, extend away from the miter joint 28 and provide a means to engage a bar clamp 40 at a tangent to the circle formed by the curved surface 17, and employ the device 10 to redirect the force to apply a contact force along direction B which is substantially normal to the contacting surfaces of the members adjoining the miter joint 28.

Again, direct contact of the clamping tools with the joining members is limited as depicted and can be eliminated through the employment of more devices 10 as interfaces, further reducing the chance of surface damage to such members. The communication of force exerted to the curved surface 17 from divergent angles to a force directed normal to the surface of the members being joined and over a larger surface area provides a much more even and directed force to the joint to achieve a much better finally engaged joint.

Further, as noted, the notch 15 formed by the curved surface 17 at its intersection with the second planar surface 21 is especially important as it provides a means to keep the elongated member 12 and the device 10 from cracking when clamping force is applied to the curved surface 17 in a manner to exert force toward the first end 13. The notch 15 helps better define an arch for communication of forces to the device and avoid a crack or damage which might occur were the curved surface 17 to turn perpendicular at its intersection with the second planar surface 21 of the elongated member 12. Additionally, the notch 15 allows for a better engagement of the foot 31 (FIG. 3) to hold the device 10 in a contact with the wood or other material.

Figure 5:
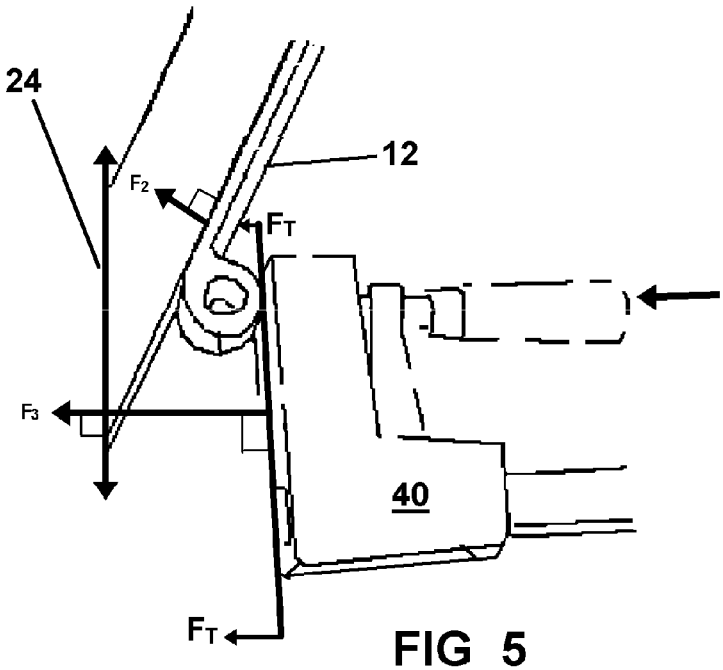
FIG. 5 depicts the device showing the ability of the curved surface to provide a means to direct force imparted thereon to the wood or material being joined, in a direction substantially normal to the joint.

FIG. 5 depicts the device 10 showing the utility of the curved surface 17 to provide a means to direct force imparted thereon, along any tangential line thereto, to the wood or other material of first 25 and second 26 joining members which is being engaged at a mitered joint 24. As can be seen, a compressive force direction F3 is directed substantially normal to the joint 28 by the impartation of a clamping force Ft tangential to the curved surface 17 and at an angle to the top or second planar surface 21. Instead of directing a force to the second planar surface 21 as would be conventional, a user may redirect the force Ft from a clamping device, to the device 10 at any of a plurality of multiple vectors. This allows the user to align the mitered joint 24 and the force Ft from a clamping means, and impart a force vector F3 perpendicular or normal to the line of the mitered joint 24. However, there is still some force being vectored along line F2 if wanted.

The redirection of force can also be seen in FIG. 4, where the device 10 held with sufficient compressive force for a frictional engagement with the underlying first 25 and second 26 joining members and the force of the opposing clamping heads engaged at angles tangent to the curved surface 17 is redirected axially down the first and second members.

FIG. 6 shows a mode of the device 10 having projections 11 rising from the second planar surface 21, and located at both the first and second ends of the member 12. Both projections communicate with the member 12 on the second planar surface 21 and employ the adjacent notch 15 formed by the curved surface 17 at its intersection with the second planar surface 21 of the elongated member 12 forming the body portion of the device 10. As noted, the notch 15 it has been found through experimentation to provides a means to keep the elongated member 12 from cracking at the intersection with the second planar surface 21 and the projection 11 when a clamping force is applied to the curved surface 17 in a manner to exert force toward the outside of the edge of the elongated member 12 on which a projection 11 is located.

As portrayed by the aforementioned figures and detailed explanations, the device 10 provides a means to use conventional clamping tools, exerting compressive force between two surfaces of the clamping tool, at divergent angles from normal to the surfaces leading to the joint. When employed in combination with any clamping tool which imparts compressive force between opposing surfaces, the device provides a means to achieve contacting forces to the members being joined, which are evenly communicated over a wide area and in forces of direction much improved to thereby communicate opposing joining forces on normally difficult miter joints or where conventional tools would cause damage.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A system for exerting a compressive force against first planar contact surfaces of first and second components which are being joined at a seam formed by two secondary surfaces, said system utilizing interface components adaptable for use with a first clamp or compressive tool, said interface components comprising:

a first elongated member having a first end opposite a second end, a first planar surface, a second planar surface opposite said first planar surface, and a sidewall communicating therebetween;

a second elongated member having a first end opposite a second end, a first planar surface, a second planar surface opposite said first planar surface, and a sidewall communicating therebetween;

a projection projecting away from said first end of said first planar surface on each of said first and second elongated members, said projection defined by a curved surface extending in a substantially circular path from said first planar surface at a first end of said curved surface and continuing to a second end of said curved surface at an intersection with said linear portion;

said intersection being substantially u-shaped and having an obtuse angle of said curved portion approaching said linear portion;

a notch located at said first intersection on each of said first and second elongated members, said notch on each of said first and second elongated members forming a substantially U-shaped transition from said first planar surface to said curved surface on each of said first and second elongated members;

said second planar surface on each of said first and second elongated members adapted for a temporary stationary contact with said first contact surface of each of said components to be joined at said seam; and said curved surface on said projection on each of said first and second elongated members adapted to provide a means to redirect a compressive force communicated from said first clamp or compressive tool against said curved surface, on each of said first and second elongated members, to against said second planar surface on each of said first and second elongated members in a second line of force substantially normal said second planar surface on each of said first and second elongated members.

2. The system of claim 1, additionally comprising:

said first elongated member adapted to be clamped by a second clamp or compressive tool, said second clamp or compressive tool adaptable to clamp said second end of said first elongated member to said planar contact surface of said first component; and said second elongated member adapted to be clamped by a third clamp or compressive tool, said third clamp or compressive tool adaptable to clamp said second end of said second elongated member to said planar contact surface of said first component.

3. The system of claim 2 formed as a unitary structure.

4. The system of claim 2 wherein said first and second components further each include a second planar contact surface, said second planar contact surface is located on a side of each of said first and second components opposite said first planar contact surface on each of said first and second components, wherein each of said second and third clamps or compressive tools includes a first jaw and a second jaw, said first jaw of each of said second and third clamps or compressive tools adapted to contact said first end of said first elongated member, said second jaw of said second clamp or compressive tool adapted to contact said second planar surface of said first component, said second jaw of said third clamp or compressive tool adapted to contact said second planar surface of said second component.

5. The system of claim 4 wherein an angle formed between said second planar contact surfaces of said first and second components when viewed from the side is an acute angle.

6. The system of claim 4 wherein an angle formed between said second planar contact surfaces of said first and second components when viewed from the side is an obtuse angle.

7. The system of claim 1, additionally comprising:

a pair of said projections on each of said first and second elongated members; and one each of said pair on each of said first and second elongated members respectively located at said first end and said second end of said first and second elongated members.

8. The system of claim 7, additionally comprising:

each said projection on each of said first and second elongated members having a curved surface thereon;

each said curved surface on each of said first and second elongated members extending from a first intersection with said first planar surface and a second intersection with said second planar surface; and a notch located at each said first intersection on each of said first and second elongated members, each said notch intersection on each of said first and second elongated members forming a substantially U-shaped transition from said first planar surface to said curved surface intersection on each of said first and second elongated members.

9. The system of claim 8 formed as a unitary structure.

10. The system of claim 7 formed as a unitary structure.

11. The system of claim 1 formed as a unitary structure.

12. The system of claim 1 wherein said second surface of each of said first and second elongated members has ruler markings formed thereon.

13. The system of claim 1 wherein an aperture is formed within an interior portion of said projection on each of said first and second elongated members.

14. Interface components for use in a system for exerting a compressive force against first planar contact surfaces of first and second components which are being joined at a seam formed by two surfaces, said system utilizing an interface component adaptable for use with a first clamp or compressive tool, said interface components comprising:

a first elongated member having a first end opposite a second end, a first planar surface, a second planar surface opposite said first planar surface, and a sidewall communicating therebetween;

a second elongated member having a first end opposite a second end, a first planar surface, a second planar surface opposite said first planar surface, and a sidewall communicating therebetween;

a projection projecting away from said first end of said first planar surface on each of said first and second elongated members, said projection defined by a curved surface extending in a substantially circular path from said first planar surface at a first end of said curved surface and continuing to a second end of said curved surface at an intersection with said linear portion;

said intersection being substantially u-shaped and having an obtuse angle of said curved portion approaching said linear portion;

wherein an aperture is formed within an interior portion of said projection on each of said first and second elongated members;

said second planar surface on each of said first and second elongated members adapted for a temporary stationary contact with said first contact surface of each of said components to be joined at said seam; and said curved surface on said projection on each of said first and second elongated members adapted to provide a means to redirect a compressive force communicated from said first clamp or compressive tool against said curved surface, on each of said first and second elongated members, to against said second planar surface on each of said first and second elongated members in a second line of force substantially normal said second planar surface on each of said first and second elongated members.

15. The interface components of claim 14, the interface components additionally comprising:

said curved surface on each of said first and second elongated members extending from a first intersection with said first planar surface and a second intersection with said second planar surface; and a notch located at said first intersection on each of said first and second elongated members, said notch on each of said first and second elongated members forming a substantially U-shaped transition from said first planar surface to said curved surface on each of said first and second elongated members.

16. The interface components of claim 14, wherein said second surface of each of said first and second elongated members has ruler markings formed thereon.

17. The interface components of claim 14, the interface components additionally comprising:

said first elongated member adapted to be clamped by a second clamp or compressive tool, said second clamp or compressive tool adaptable to clamp said second end of said first elongated member to said planar contact surface of said first component; and said second elongated member adapted to be clamped by a third clamp or compressive tool, said third clamp or compressive tool adaptable to clamp said second end of said second elongated member to said planar contact surface of said first component.

18. The system of claim 14, wherein an angle formed between said second planar contact surfaces of said first and second components when viewed from the side is an acute angle.

19. The system of claim 14, wherein an angle formed between said second planar contact surfaces of said first and second components when viewed from the side is an obtuse angle.

* * * * *